US006726027B2

(12) United States Patent
Pferdmenges et al.

(10) Patent No.: US 6,726,027 B2
(45) Date of Patent: Apr. 27, 2004

(54) DEVICE FOR SPINNING PREPARATION

(75) Inventors: Gerd Pferdmenges, Jüchen (DE); Robert Pischel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/321,519

(22) Filed: Dec. 18, 2002

(65) Prior Publication Data

US 2003/0116483 A1 Jun. 26, 2003

(30) Foreign Application Priority Data

Dec. 21, 2001 (DE) ..... 101 63 178

(51) Int. Cl.[7] ..... D01G 15/80

(52) U.S. Cl. ..... 209/615; 19/105; 19/98; 19/109

(58) Field of Search ..... 209/615; 19/105, 19/98, 205, 109, 108

(56) References Cited

U.S. PATENT DOCUMENTS 4,797,980 A * 1/1989 Jagst ..... 19/107

FOREIGN PATENT DOCUMENTS

| | | |
|---|---|---|
| DE | 28 46 109 A1 | 5/1980 |
| DE | 30 34 036 A1 | 4/1982 |
| DE | 33 36 323 A1 | 5/1985 |
| EP | 0 387 908 A1 | 9/1990 |
| EP | 0 388 791 A1 | 9/1990 |

* cited by examiner

*Primary Examiner*—Donald P. Walsh
*Assistant Examiner*—Jonathan R Miller
(74) *Attorney, Agent, or Firm*—Venable LLP; Robert Kinberg; Stuart I. Smith

(57) ABSTRACT

A device is provided for a spinning preparation machine for removing foreign particles, the machine having a rotating cylinder with ends. The device has a knife blade having a separation edge, the knife blade being arranged at an adjustable distance to and angled counter to a rotational direction of the cylinder; a suctioning chamber associated with the knife blade; a holding element to which the knife blade and the suctioning chamber are attached; and at least one adjusting element. The holding element, the knife blade and the suctioning chamber form a single adjustable unit. A position of the single adjustable unit relative to the cylinder is adjustable by adjusting the at least one adjusting element. The at least one adjusting element is located outside one of the ends of the cylinder in a longitudinal direction of the cylinder and in a region of the separation edge on the knife blade.

20 Claims, 6 Drawing Sheets

DEVICE FOR SPINNING PREPARATION

CROSS-REFERENCE TO RELATED APPLICATION

This application claims priority to German Patent Application No. 101 63 178.2, filed Dec. 21, 2001, the disclosure of which is incorporated herein by reference.

BACKGROUND OF THE INVENTION

The invention relates to a device on a machine for spinning preparation, for example a carding machine, for removing foreign particles such as trash and the like. The device is provided with a knife blade that is arranged with adjustable spacing and pointing counter to the rotational direction of a roll, for example the main carding cylinder, and is provided with a suctioning chamber associated with the knife blade. The knife blade and the suctioning chamber are attached to a holding element and jointly form a structural component. A distance from the knife blade to the cylinder can be adjusted with at least one adjustment element.

A device of this type is shown in German Unexamined Published Patent Application 30 34 036 and is provided with a housing that forms a component of a profile body. The profile body is attached to the carding machine frame and extends over the complete width of the carding machine. A circular-cylindrical hollow space inside the housing functions as a suctioning chamber and is connected to a vacuum source. The knife blade is also attached to the profile body, so that the device for removing foreign particles forms a single structural component that can be replaced. The distance between this component and the main carding cylinder can be adjusted with screws. One considerable disadvantage of this device is that the adjustment screws, as seen in the rotational direction of the cylinder, are arranged a distance from the separation edge of the knife blade. As a result, a lever arm is formed between the locally fixed screws and the exposed separation edge. This lever arm makes it extremely difficult to securely reproduce the spacing between the separation edge and the cylinder following a dismantling and re-assembly. Involved reworking and aligning operations are consequently required since the adjustment occurs at a distance from the separation edge and the cylinder. In addition, the presence of loose fastening parts during the dismantling is bothersome.

SUMMARY OF THE INVENTION

It is an object of the invention to create a device of the aforementioned type that avoids the above-mentioned disadvantages. Following a dismantling and reassembly, for example, the device is designed to securely and easily maintain the spacing existing prior to the dismantling between the separation edge and the cylinder.

Embodiments of the invention provide a device for a spinning preparation machine for removing foreign particles, the machine having a rotating cylinder with ends. The device has a knife blade having a separation edge, the knife blade being arranged at an adjustable distance to and angled counter to a rotational direction of the cylinder; a suctioning chamber associated with the knife blade; a holding element to which the knife blade and the suctioning chamber are attached; and at least one adjusting element. The holding element, the knife blade and the suctioning chamber form a single adjustable unit. A position of the single adjustable unit relative to the cylinder is adjustable by adjusting the at least one adjusting element. The at least one adjusting element is located outside one of the ends of the cylinder in a longitudinal direction of the cylinder and in a region of the separation edge on the knife blade.

Because the adjustment element provided on each side of the cylinder is arranged in the region of the knife blade separation edge, the position of the separation knife relative to the cylinder does not change following dismantling and re-assembly. The adjustment occurs at a short distance to the longitudinal axis of the adjustment screw. As a result, it is possible to securely reproduce the spacing between a holding element for the knife blade and the suctioning hood. It is furthermore advantageous that this adjustment can be reproduced even if the holding element side facing the cylinder has uneven spots or is not perfectly aligned.

BRIEF DESCRIPTION OF THE DRAWINGS

The invention is explained below in further detail with the aid of exemplary embodiments shown in the drawings, wherein.

DETAILED DESCRIPTION OF THE INVENTION

Figure 1:
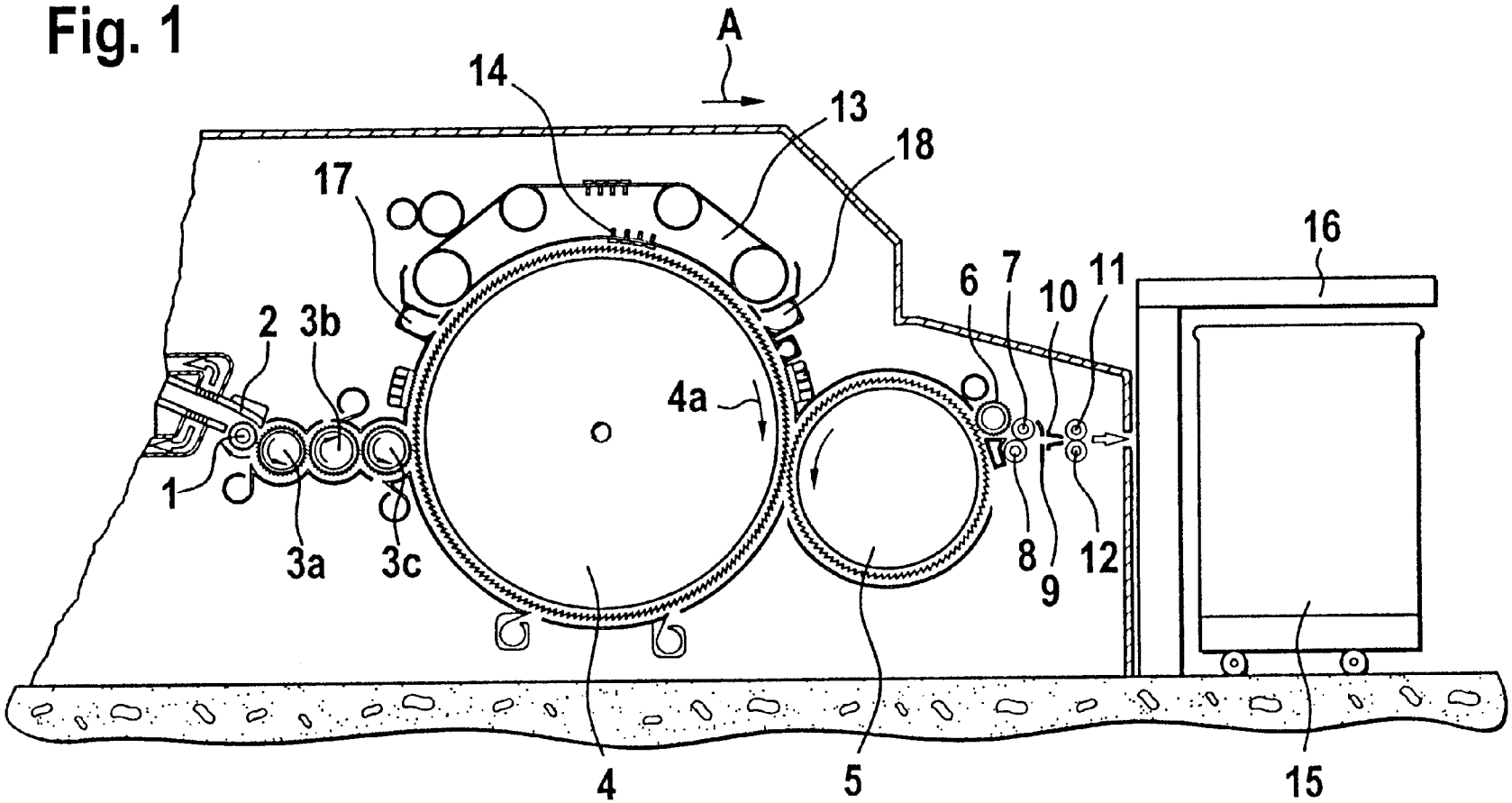
FIG. 1 is a side elevation view of a carding machine with an example of a device according to the invention.

FIG. 1 shows a carding machine, for example a high-performance carding machine model DK 903 by the company Trützschler in Mönchengladbach, Germany. The carding machine has a feed roll 1, a feed table 2, licker-ins 3*a*, 3*b*, 3*c*, a main carding cylinder 4, a doffer 5, a stripping roll 6, crushing rolls 7, 8, a sliver guide element 9, a web trumpet 10, withdrawing rolls 11, 12, traveling flats 13 with clothed flat bars 14, a can 15 and a can holder arrangement 16. Curved arrows indicate the rotational directions of the rolls while the arrow A indicates the operating direction. A suctioning chamber 17 in a pre-carding region and a suctioning chamber 18 in a post-carding region are also shown.

Figure 2:
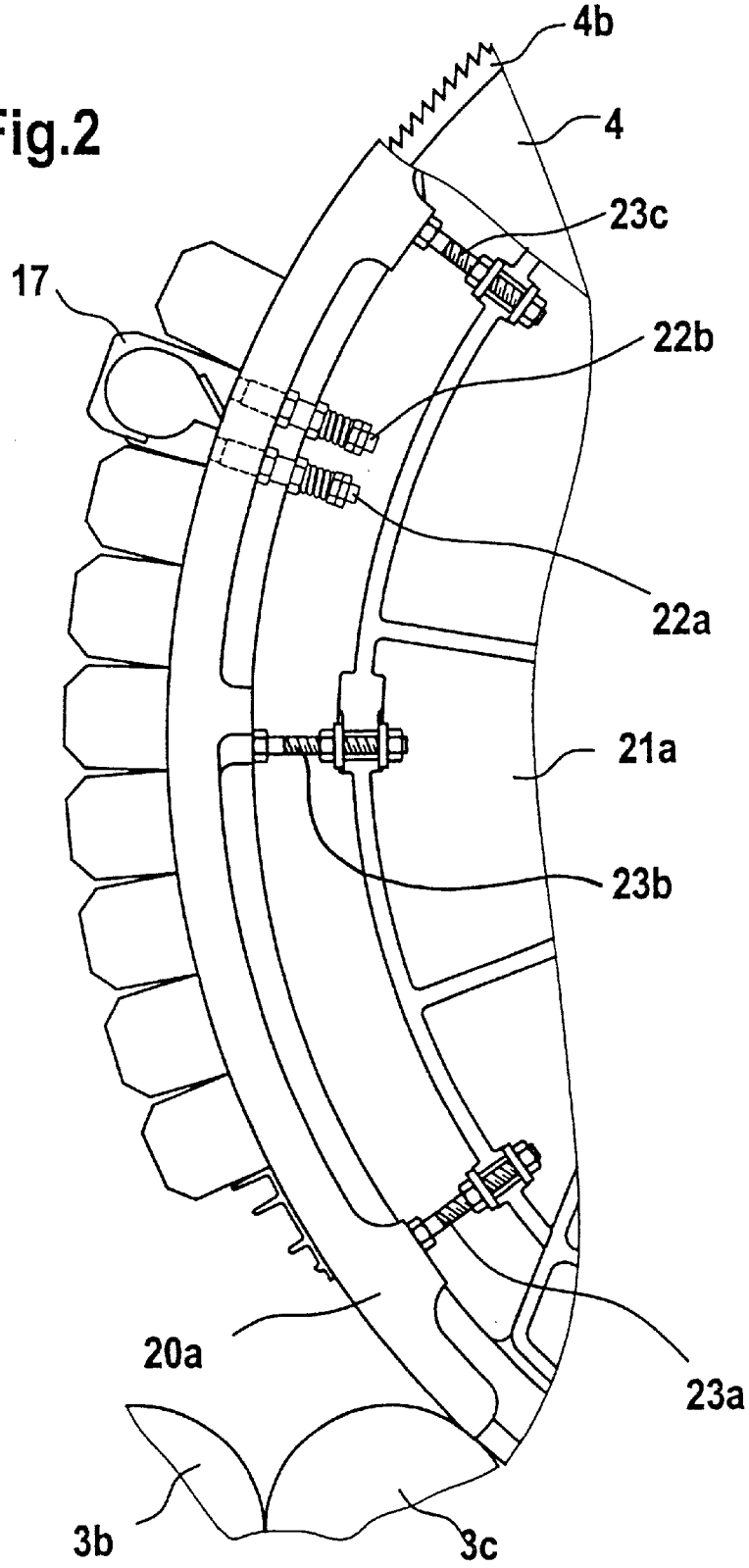
FIG. 2 shows a device according to the invention with a suctioning chamber in the pre-carding zone of a carding machine with traveling flats.

As shown in FIG. 2, the suctioning chamber 17 is attached with two adjustment screws 22*a*, 22*b* to an extension bend 20*a*. A similar extension bend is preferably provided at a separate location on the carding machine. The extension bends, in turn, are attached on the respective sides of the carding cylinder to card end covers, for example, 21*a*. The extension bend 20*a* can be adjusted in a radial direction with the aid of adjustment spindles 23*a*, 23*b*, 23*c*. Main carding cylinder 4 is provided with carding 4*b*.

Figure 3A:
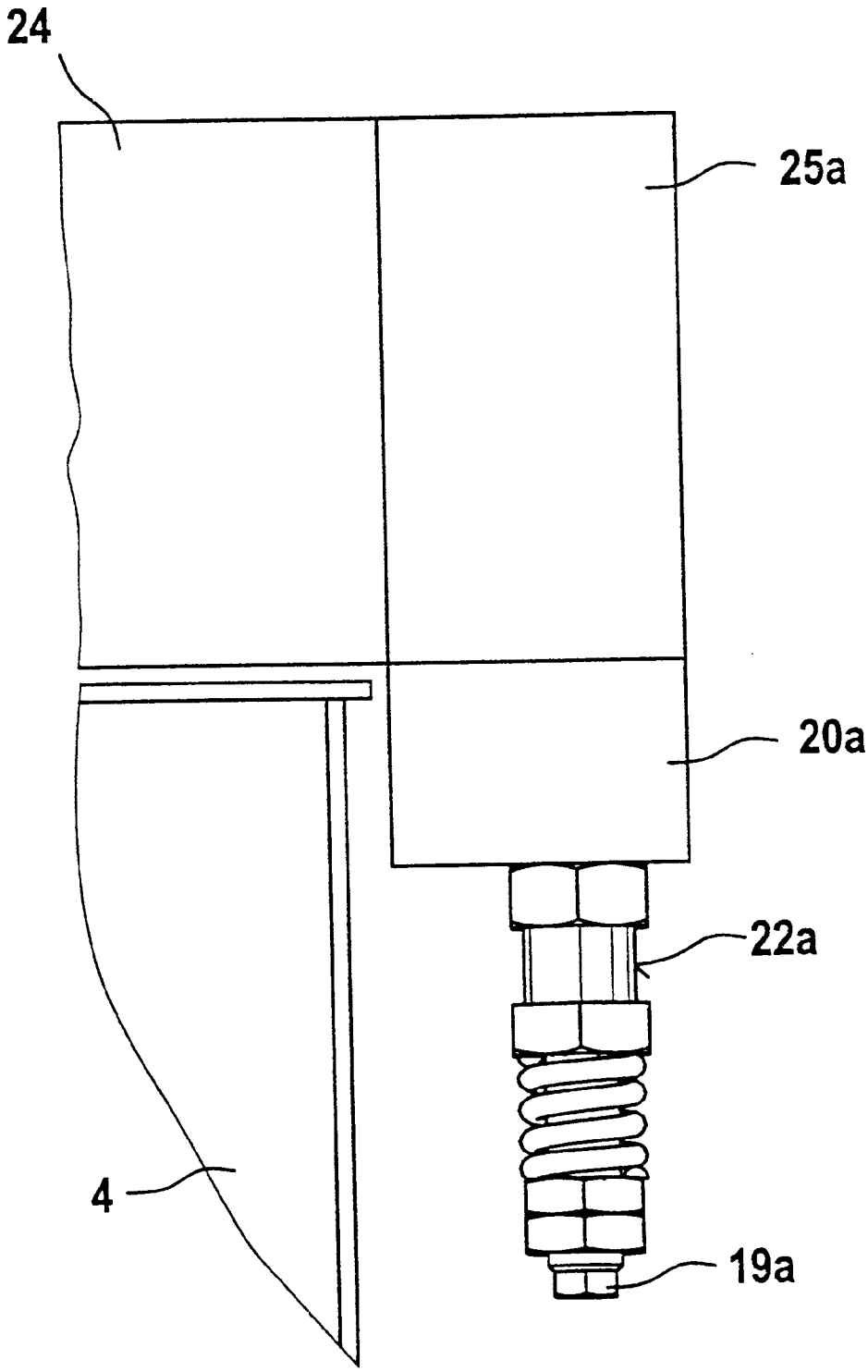
FIG. 3*a* is a side elevation view of a device according to the invention with an adjustment element and a fastening screw.
Figure 3B:
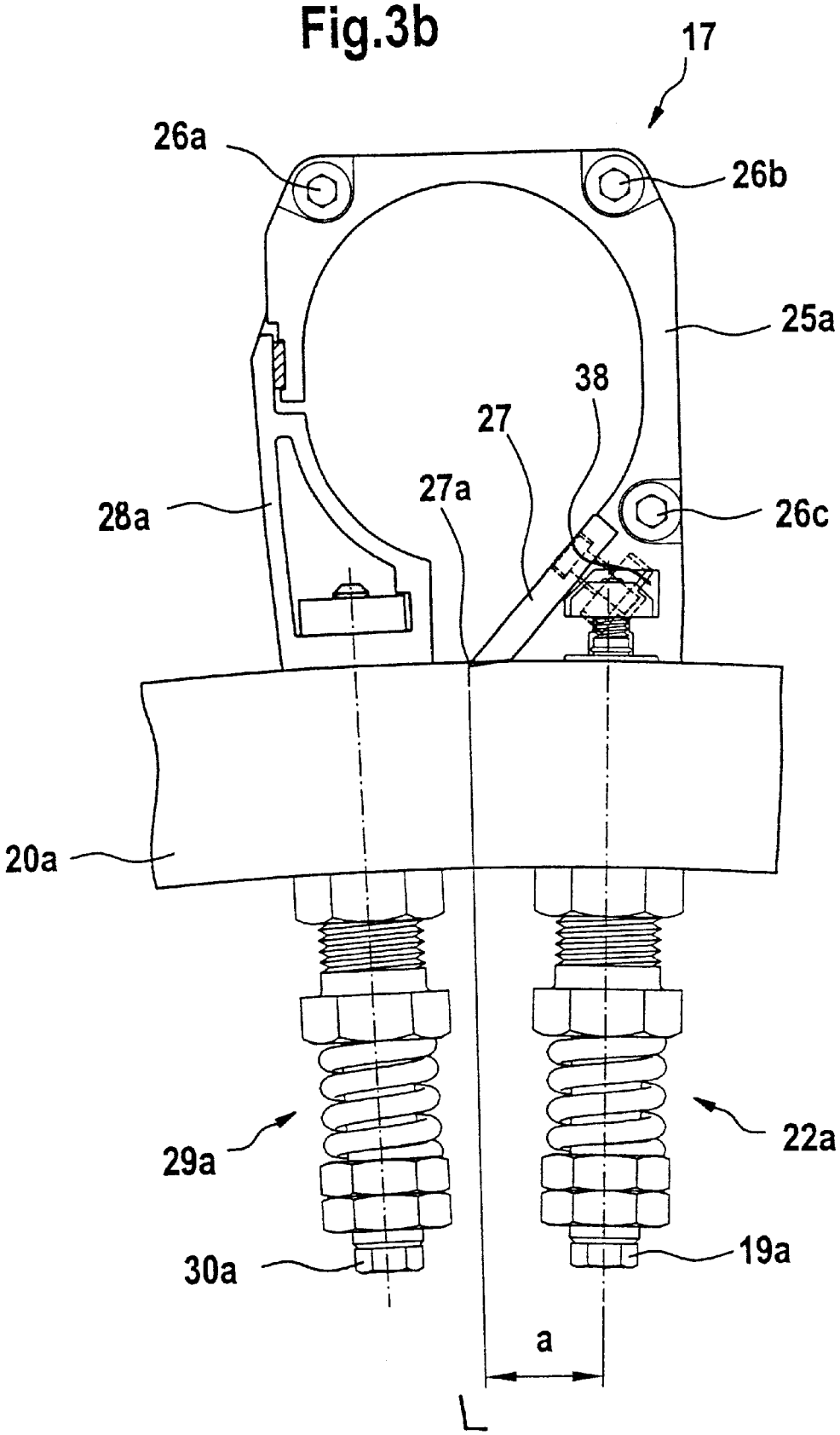
FIG. 3*b* is a partial view from the front of the device according to FIG. 3*a*, with a partial representation of the main carding cylinder.

As shown in FIG. 3*a*, the suctioning chamber 17 comprises a hollow profile element 24, e.g. an extruded aluminum profile, which extends over the width of the main carding cylinder 4, and two adapters (only one adapter 25*a* is shown in FIG. 3) as holding elements that are attached to the ends of the hollow profile element 24. The adjustment element 22*a* (see FIG. 3*b*) and a fastening screw 19*a* (see FIG. 3*b*) are associated with the adapter 25*a*. The adapter 25*a*, the adjustment element 22*a*, and the fastening screw 19*a* (and their counterparts on the other end of the hollow profile element 24) are arranged outside of the respective ends of the main carding cylinder 4.

As shown in FIG. 3*b*, the adapter 25*a* is attached with equal area and with screws 26*a*, 26*b*, 26*c* to one end of the hollow profile 24. Similar to the hollow profile 24, the adapter 25*a* has a hollow space on the inside through which air can flow. A knife blade 27 is attached to the suctioning chamber 24, e.g. with screws, in the region that is facing the main carding cylinder 4. The adjustment element 22*a*, through which the fastening screw 19*a* extends, has an adjustment and fastening function while the fastening screw 19*a* only serves as fastening means. For fastening, one end of the fastening screw 19*a* is screwed into the adapter 25*a*. The adjustment element 22*a* secures the fastening screw 19*a* (and thus also the adapter 25*a*) on the extension bend 20*a*. In addition, the adjustment element adjusts the spacing of the adapter 25*a* in a radial direction (and thus also the spacing between the knife blade 27 and the hollow profile element 24 and the surface of the main carding cylinder 4).

A cover section 28*a* adjoins the exposed longitudinal edge of the adapter 25*a* and leaves an open gap opposite the knife blade 27. Through this gap, trash and similar items enter the inside space of the hollow profile 24 and are then suctioned out of this space. An adjustment element 29*a* and a fastening screw 30*a* are associated with the cover section 28*a*. With respect to design and function, these adjustment elements resemble the adjustment element 22*a* and the fastening screw 19*a*. The adjustment element 22*a* is arranged in the area of and adjacent to a separation edge 27*a* of the knife blade 27. The adjustment element 22*a* can arrange the axial center line or the longitudinal axis L such that it points in a radial direction, relative to the center of the main carding cylinder 4, thus creating a distance a.

As shown in FIG. 3*b*, the distance a of approximately 15 to 25 mm exists between the knife edge 27*a* and the center line of the adjustment element 22*a*. In principle, the adjustment element 22*a* can be arranged with a distance a toward each side, with respect to the separation edge 27*a*, for example approximately 30 mm in each direction. That is to say, the distance can range, for example, from 0 to approximately 30 mm toward both sides.

Figure 3C:
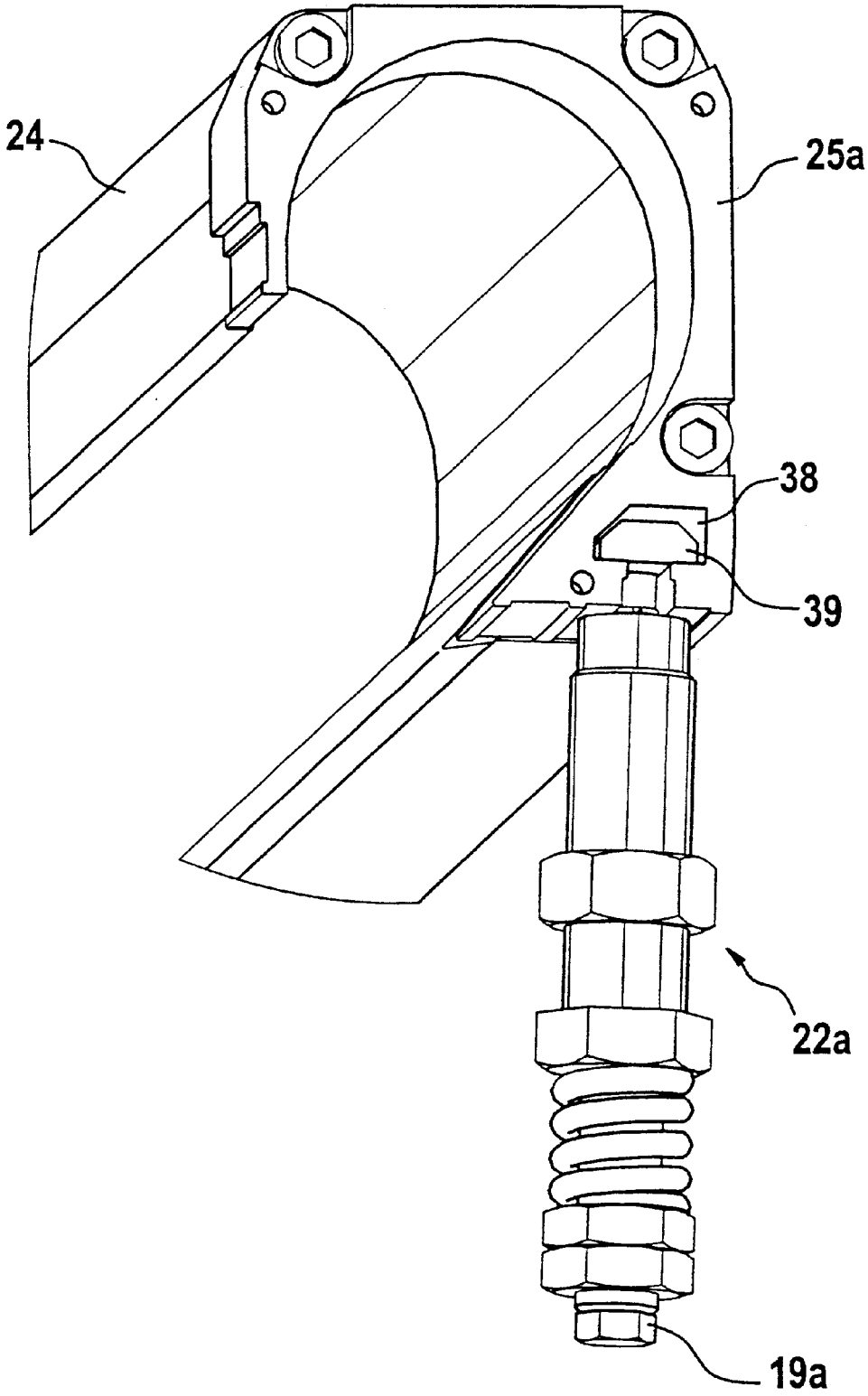
FIG. 3*c* is a partial perspective view of the device according to FIGS. 3*a* and 3*b*.

FIG. 3*c* shows another view of the adapter 25*a* on the end of the hollow profile element 24. Thus, it forms a hollow space for suctioning on the inside the suctioning hood, wherein the exposed front side of the adapter 25*a* is connected to a suction line (not shown). A sliding block 39 that is attached to the exposed end of the fastening screw 19*a* engages a T-shaped groove 38, provided in the base region of the adapter 25*a*.

Figure 4:
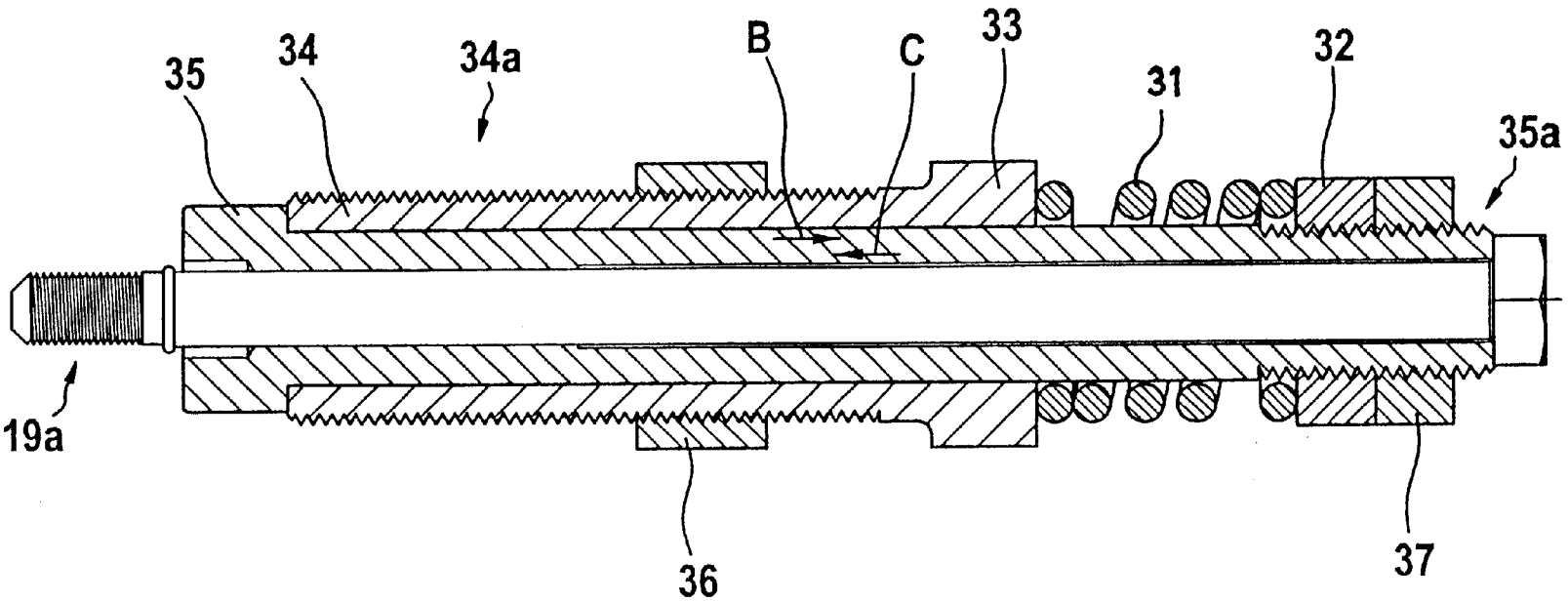
FIG. 4 is a section through the adjustment element with a fastening screw.

As shown in FIG. 4, a compression spring 31 extends around the fastening screw 19*a* and supports itself with one end in an adjustment recess 32 and with the other end on the level surface of a dome-shaped cap 33 on a hollow bolt 34. In turn, the hollow bolt 34 sits coaxially on a hollow bolt 35 that can be displaced in the inside space of the hollow bolt 34. The hollow bolt 34 is provided with an external thread 34*a* onto which a fastening screw 36 is screwed. One end region of the hollow bolt 35 is provided with an external thread 35*a* onto which the adjustment screw 32 and a locknut 37 are fitted. The hollow bolt 34 is screwed via the thread 34*a* into a bore with internal threads, located in the extension bend 20*a*, and is secured with the fastening screw 36. The hollow bolt 35 is displaced in the direction of arrow B or C by turning the adjustment screw 32. The fastening screw 19*a* (with adapter 25*a*) is at the same time also displaced in the direction of arrows B or C.

The adjustment element 22*a*, 29*a* each comprise the components 31 to 37. Components 33, 34 and 36 are used to secure the adjustment element itself while components 31, 32 and 35 serve to adjust the adapter 25*a*.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A device on a spinning preparation machine for removing foreign particles, the machine having a rotating cylinder with ends, the device comprising:

a knife blade having a separation edge, the knife blade being arranged at an adjustable distance to and angled counter to a rotational direction of the cylinder;

a suctioning chamber associated with the knife blade;

a holding element to which the knife blade and the suctioning chamber are attached;

at least one adjusting element; and a fastening element, wherein the holding element, the knife blade and the suctioning chamber form a single adjustable unit, a position of the single adjustable unit relative to the cylinder is adjustable by adjusting the at least one adjusting element, the fastening element being for securely holding the single adjustable unit in the position while the position is being adjusted by the at least one adjusting element, and the at least one adjusting element is located outside one of the ends of the cylinder in a longitudinal direction of the cylinder and in a region of the separation edge on the knife blade.

2. The device according to claim 1, wherein the at least one adjusting element is a screw element.

3. The device according to claim 2, wherein the knife edge is positioned essentially on the longitudinal axis of the screw element.

4. The device according to claim 1, wherein the adjusting element engages in the holding element.

5. The device according to claim 1, wherein the holding element extends beyond the ends of the cylinder.

6. The device according to claim 1, further comprising a second holding element, wherein one of the holding element and the second holding element is located on each end of the suction chamber.

7. The device according to claim 6, wherein the holding element and the second holding element are located outside the ends of the cylinder in the longitudinal direction of the cylinder.

8. The device according to claim 1, wherein the suction chamber is an extruded profile.

9. The device according to claim 1, wherein the holding element is provided with a receiving opening for holding and connecting the adjusting element.

10. The device according to claim 1, further comprising a suction line, wherein the holding element has a discharge opening and the suction line is connected to the discharge opening.

11. The device according to claim 10, wherein the suction line is for connecting to a central suctioning system for the machine.

12. The device according to claim 1, wherein the adjusting element is for engaging in an extension bend of the machine.

13. The device according to claim 1, further comprising a spring, wherein the adjusting element is stressed by the spring.

14. The device according to claim 1, wherein the holding element and the suctioning chamber are separate pieces.

15. The device according to claim 1, wherein the adjusting element adjusts a spacing between the holding element and the cylinder.

16. A device on a spinning preparation machine for removing foreign particles, the machine having a rotating cylinder with ends, the device comprising:

a knife blade having a separation edge, the knife blade being arranged at an adjustable distance to and angled counter to a rotational direction of the cylinder;

a suctioning chamber associated with the knife blade;

a holding element to which the knife blade and the suctioning chamber are attached; and at least one adjusting element, wherein the holding element, the knife blade and the suctioning chamber form a single adjustable unit, a position of the single adjustable unit relative to the cylinder is adjustable by adjusting the at least one adjusting element, the at least one adjusting element is located outside one of the ends of the cylinder in a longitudinal direction of the cylinder and in a region of the separation edge on the knife blade, and the at least one adjusting element is a screw element and the adjustment occurs substantially along a longitudinal axis of the screw element.

17. A device on a spinning preparation machine for removing foreign particles, the machine having a rotating cylinder with ends, the device comprising:

a knife blade having a separation edge, the knife blade being arranged at an adjustable distance to and angled counter to a rotational direction of the cylinder;

a suctioning chamber associated with the knife blade;

a holding element to which the knife blade and the suctioning chamber are attached, the holding element being provided with a receiving opening for holding and connecting the adjusting element; and at least one adjusting element, wherein the holding element, the knife blade and the suctioning chamber form a single adjustable unit, a position of the single adjustable unit relative to the cylinder is adjustable by adjusting the at least one adjusting element, the at least one adjusting element is located outside one of the ends of the cylinder in a longitudinal direction of the cylinder and in a region of the separation edge on the knife blade, and the receiving opening is a T-shaped groove.

18. The device according to claim 17, wherein an exposed end of the adjusting element is T-shaped.

19. A device on a spinning preparation machine for removing foreign particles, the machine having a rotating cylinder with ends, the device comprising:

a knife blade having a separation edge, the knife blade being arranged at an adjustable distance to and angled counter to a rotational direction of the cylinder;

a suctioning chamber associated with the knife blade;

a holding element to which the knife blade and the suctioning chamber are attached;

at least one adjusting element; and a fastening screw, wherein the holding element, the knife blade and the suctioning chamber form a single adjustable unit, a position of the single adjustable unit relative to the cylinder is adjustable by adjusting the at least one adjusting element, and the at least one adjusting element is a screw element and is located outside one of the ends of the cylinder in a longitudinal direction of the cylinder and in a region of the separation edge on the knife blade, the adjusting element has a bore, and the fastening screw is arranged coaxially inside the bore of the adjusting element.

20. The device according to claim 19, wherein the holding element is attached to the adjusting element by the fastening screw.

* * * * *